United States Patent [19]

Bachman et al.

[11] 4,066,459

[45] Jan. 3, 1978

[54] FREE RADICAL PHOTOSENSITIVE COMPOSITIONS WITH IMPROVED SENSITIVITY AND SHELF LIFE STABILITY

[75] Inventors: Paul L. Bachman, Cleveland Heights; John J. Moskal, Bedford, both of Ohio

[73] Assignee: Horizons Incorporated, a division of Horizons Research Incorporated, Cleveland, Ohio

[21] Appl. No.: 652,159

[22] Filed: Jan. 26, 1976

[51] Int. Cl.[2] ..... G03C 5/32; G03C 1/52; G03C 1/76

[52] U.S. Cl. ..... 96/45.2; 96/67; 96/90 R; 96/48 QP; 96/48 R

[58] Field of Search ..... 96/90 R, 90 PC, 48 R, 96/48 QP, 56, 45.2, 109, 50 PL, 67

[56] References Cited

U.S. PATENT DOCUMENTS

| | | | |
|---|---|---|---|
| 3,042,515 | 7/1962 | Wainer | 96/90 R |
| 3,394,395 | 7/1968 | Mattor et al. | 96/90 R |
| 3,442,649 | 5/1969 | Rasch et al. | 96/50 PL |
| 3,697,272 | 10/1972 | Ramins | 96/90 R |
| 3,817,752 | 6/1974 | Laridon et al. | 96/48 R |
| 3,843,367 | 10/1974 | Schranz | 96/56 |

*Primary Examiner*—Won H. Louie, Jr.
*Attorney, Agent, or Firm*—Lawrence I. Field

[57] ABSTRACT

This invention relates to free-radical, non-silver, photosensitive films, particularly those suitable for optical development as described in U.S. Pat. No. 3,510,300. The invention comprises the incorporation of compounds which contain an imine (—C=N—) function and a hydroxyl group into otherwise known photosensitive compositions to improve optical development and to retard dark fogging so as to thereby provide aging stability to such compositions. Preferably, an additional improvement comprises provision of an overcoat for the photosensitive composition of this invention when in the form of thin films on a support such as a polyester or a paper sheet or glass plate. The overcoat acts to improve the shelf life and photosensitometric properties of the photosensitive composition.

13 Claims, No Drawings

FREE RADICAL PHOTOSENSITIVE COMPOSITIONS WITH IMPROVED SENSITIVITY AND SHELF LIFE STABILITY

This invention relates to free-radical, non-silver, photosensitive films particularly those suitable for optical development as described in U.S. Pat. No. 3,510,300, issued May 5, 1970.

The present invention is addressed to the improvement of the compositions described in that patent and in other prior art, which compositions consist essentially of:

1. a source of free-radicals, usually an organic halogen compound which produces a free-radical when exposed to a suitable dose of radiation, hereinafter referred to as an activator; and 2. at least one compound which prints out an image in areas in which such free-radicals are produced.

It has now been found that compounds which contain an imine function in combination with a hydroxyl group are not only also effective in inhibiting fog formation in said compositions, but furthermore, also provide aging stability for amplification by optical development thereby permitting the attainment of higher photographic speeds, than are attained by otherwise similar compositions to which the imino compounds have not been added.

U.S. Pat. No. 3,510,300 issued May 5, 1970, describes the process of optical development wherein a nonsilver, organic free-radical photosensitive composition, comprising an activator (usually an organic halogen compound) and a dye base or leuco triarylmethane dye progenitor is given an imagewise exposure to radiation to produce a latent image and is then given a blanket exposure to radiation of suitable wavelength for rendering visible the previously formed latent image. U.S. Pat. No. 3,697,272 issued Oct. 10, 1972 describes improvement on the earlier process wherein exposure to radiation of two different wavelengths produces greater photographic speeds of photosensitive compositions comprising styryl quinoline dye progenitors employing a halogen activator.

It has been found that the optical development process is also applicable to compositions comprising a halogen activator in combination with at least one dye base and at least one leuco dye progenitor. However, many such compositions exhibit such poor shelf life stability toward the optical development process that a sizeable loss of development capability, and consequently photographic speed, occurs within fifteen minutes to one hour of preparation.

The use of the imine containing organic hydroxyl compounds of the present invention produces a significant improvement over prior art stabilizers in that they stabilize against dark fogging while not adversely affecting the optical development process and they improve the aged development as compared to development in the absence of any such stabilizer.

The stability of the photosensitive compositions of this invention is an extremely complex, incompletely understood phenomenon. An earlier filed application Ser. No. 364,092 filed May 25, 1973 describes one manner of overcoming external causes of instability such as oxidizing and acidic contaminants as well as the physical loss of volatile halogen activator. It appears that the optical development process may operate by a different mechanism than the printout process, with its own set of internal chemical instabilities. Thus, while not wishing to be bound by any specific theory, it appears that at least parts of the optical development mechanism operate independently from the mechanism of dark fogging and that some prior art stabilizers, while effective against dark fog, coincidentally and simultaneously interfere with some stage of the optical development mechanism. In contrast, the stabilizers of the present invention are effective in inhibiting dark fog formation and in addition they favorably affect the development mechanism.

The imines which are useful to this invention are compounds which contain an imine function, —C=N— in combination with one or more hydroxyl groups. More specifically, they are hydroxylamines or Schiff's bases containing an adjacent phenolic hydroxyl group or both. The specific nature of these compounds is evident from the following compounds which are representative of the general classes and are not intended to be all inclusive.

Table 1

| | | |
|---|---|---|
| 1. | $CH_3-C(=NOH)-C(=NOH)-CH_3$ | dimethylglyoxime |
| 2. | 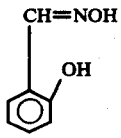 | salicylaldoxime |
| 3. | 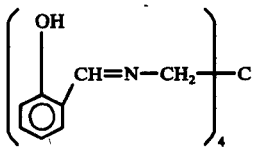 | N,N'N'',N'''-tetra-salicylidene penta-erythrityl tetramine |
| 4. | 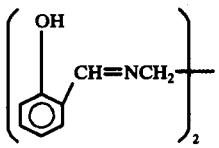 | N,N'-bis(salicylidene)-1,2-ethylenediamine |
| 5. | 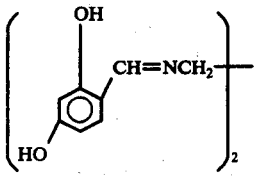 | 1,2-bis(2,4-dihydroxy-benzal) ethylenediamine |
| 6. | 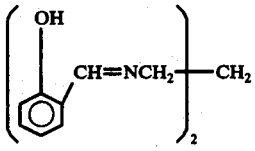 | N,N'-disalicylidene-1,3-propanediamine |
| 7. | 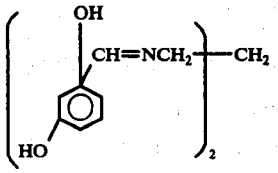 | 1,3-bis(2,4-dihydroxy-benzal)-1,3-propanediamine |
| 8. | 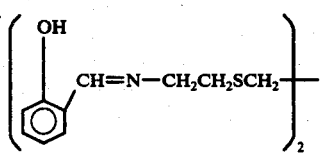 | 1,8-bis(salicylidene amino)-3,6-dithiaoctane |

Table 1-continued

| | | |
|---|---|---|
| 9. | 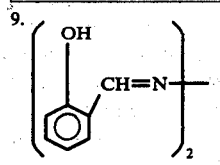 | salicyladazine |

The imino compounds which are effective for the present invention appear to fall in the following classes:

I. Compounds represented by the general formula

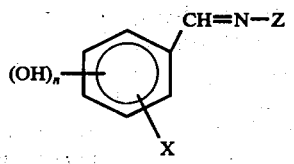

which may be described as Schiff's bases of a salicylaldoxime and a primary amine, and in which $n$ is an integer up to 3 and the OH groups occupy at least one ortho-site; X is an alkyl, aryl, or halogen group; and Z is selected from the group consisting of OH, alkyl up to 4 carbon atoms, a covalent bond connecting the parts of a bis-compound e.g. as shown in compounds 4, 5, 8 and 9 of Table I above and $—CH_2CH_2SCH_2—$;

II. Compounds containing an oxime nucleus

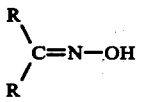

in which each R is selected from the group consisting of H,

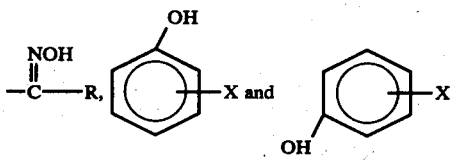

where X is as in (I) above.

In addition to the imine, hydroxyl compounds, the photosensitive composition consists essentially of (1) at least one leuco compound, (2) at least one dye base, (3) at least one activator, (4) a suitable binder, and (5) any of a large number of constituents which may be added for a particular purpose and which may be considered optional. These constituents are described more extensively in the prior art including U.S. Pat. Nos. 3,285,744 issued Nov. 15, 1944; 3,510,309 issued May 5, 1970; and 3,042,515 issued July 3, 1962, the disclosures of which are intended to be incorporated herein by this reference.

LEUCO COMPOUNDS

The leuco compounds useful in the practice of the present invention include Leuco Crystal Violet, Leuco Malachite Green, Leuco Opal Blue and other leuco triaryl methane compounds as well as other leuco compounds such as leuco anthracenes, leucoxanthenes, leucothioxanthenes, leucoselenoxanthenes and leuco acridenes.

DYE BASE

Styryl and cyanine dye bases suitable for the photosensitive compositions of the present invention are described in U.S. Pat. Nos. 3,100,703 issued Aug. 13, 1963; 3,102,810 issued Sept. 3, 1963; and 3,095,303 issued June 25, 1963 and suitable merocyanine dye bases are described in U.S. Pat. No. 3,109,736 issued Nov. 5, 1963, the disclosures of which are intended to be incorporated herein by this reference.

FREE RADICAL SOURCES

The leuco compounds and dye bases described above experience a color change or print out an image when in the presence of free radicals produced as a result of the exposure of certain organic halogen compounds to suitable electromagnetic radiation. The organic halogen compounds which are suitable in the light sensitive compositions to which the present invention is applicable are those represented by the general formula $A—C—X_3$ wherein A represents halogen (Cl, Br or I), alkyl, substituted alkyl, including halogen substituted alkyl, aryl, substituted aryl, aroyl, and aralkyl and wherein each X represents a halogen atom which may be either chlorine, bromine or iodine, it being understood that not all of the X atoms need be alike. Bromine is a preferred X. Preferred compounds are $\alpha,\alpha,\alpha$,-tribromoacetophenone and halogen substituted alkanes such as $CBr_4$, $CHI_3$ or $C_2HBr_5$.

BINDER

One convenient way of utilizing the photosensitive compositions of this invention is to dissolve all of the constituents in a solvent or mixture of solvents and then cast the solution onto an inert support such as glass, or a synthetic resin polymer or to dip an absorbent material such as paper into a solution. To preserve the association of constituents after the solvent has evaporated, it is preferred to include a film forming binder in the composition as described in any of the above noted patents.

OPTIONAL CONSTITUENTS

Other constituents which may be added to produce special benefits may include compounds to alter the sensitivity, or to plasticize or otherwise modify the composition, without departing from the intended scope of the invention. The addition of N-oxides as described in U.S. Pat. No. 3,481,739 issued Dec. 2, 1969 is one such particularly preferred, optional addition, optional for the direct printout mode of this invention but essential for the optical development mode.

PROPORTIONS

The compositions of this invention have the following proportions of the several components:

| Constituent | Broad Range | Preferred |
|---|---|---|
| Organic Halogen Compound | .10 – 10 | 1 – 4 |
| Leuco Dye | .01 – 0.1 | .4 – .1 |
| Dye Base | .5 – .01 | .05 – 0.2 |
| Imine Compound | .01 – 5* | .05 – 1.5* |
| Binder | 1 | 1 |

*times the combined weight of leuco compound and dye base.

The examples which follow are intended to illustrate preferred embodiments of the invention and are not intended to limit the same in any way.

EXAMPLE I

A photosensitive composition was prepared by dissolving 2,7-bis(dimethylamino)-10-p-dimethylaminophenyl-9,10-dihydro-9,9-dimethylanthracene (100 mg), 4-ethylpyridine-N-oxide (30 mg), 4-(p-dimethylaminostyryl)-quinoline (50 mg), and carbon tetrabromide (1.4 g) in 4 ml of a 10% by weight solution of polystyrene in benzene. The solution was coated 0.0015 inches wet thickness on a polyethylene terephthalate base using a vacuum channel plate and drawbar applicator. The film was allowed to air-dry several minutes, and a polyvinylalcohol overcoat was then applied. A 10% aqueous solution of Elvanol 52-22 polyvinylalcohol was applied with a drawbar at a wet thickness of 0.006 inches and allowed to air-dry for fifteen minutes. The resulting film was then removed from the coating plate and cut into strips which were placed in boxes and stored at ambient temperature.

One strip was immediately exposed through a standard Kodak Type 1A steptablet to a uniform light source corrected to a color temperature of 5700° K, then fixed by rinsing for several minutes in a solution of petroleum ether/acetone/Stoddard solvent (8:2:1 by volume). Other strips were identically processed after storing for three, twenty-four and forty-eight hours. The Base plus FOG densities as measured with a Wratten 93 green filter were:

| Storage | 0 Hours | 3 Hours | 24 Hours | 48 Hours |
|---|---|---|---|---|
| Base + Fog | 0.09 | 0.13 | 0.24 | 0.95 |

EXAMPLE II

Three photosensitive compositions were prepared according to Example I to which were added 3.2, 11.2 and 28.1 milligrams of salicylaldoxime (2) respectively. Overcoated films were then prepared and processed in the same manner as in Example I. The effect on dark fogging can be seen from Table 2.

Table 2

| Amount (mg) | Base + Fog After Storage for Various Times | | | | |
|---|---|---|---|---|---|
| | 0 Hrs. | 19 Hrs. | 68 Hrs. | 92 Hrs. | 188 Hrs. |
| 3.2 | .06 | .06 | .06 | .06 | .06 |
| 11.2 | .06 | .06 | .06 | .06 | .06 |
| 28.1 | .06 | .07 | .07 | .07 | .07 |

EXAMPLE III

A photosensitive composition was prepared by dissolving in 9 ml of a 10% by weight solution of a polymethacrylate ester in benzene:

2,7-bis(dimethylamino)-10-p-dimethylaminophenyl-9,10-dihydro-9,9-dimethylanthracene (100 mg);
4-(p-dimethylaminostyryl)-quinoline (40 mg); and
4-methylpyridine-N-oxide (1.3 g). An overcoated film was prepared and processed as in Example I. A 35,000 MCS direct printout exposure produced an eight-step blue image with a Base plus Fog density of 0.06 as read with a Wratten 93 green filter. A second strip which had been stored for 24 hours at an ambient temperature of 70° F had a Base plus Fog of 2.42.

EXAMPLE IV

The photosensitive composition of Example III was prepared and 110 mg of N,N',N'',N'''-tetrasalicylidene pentaerythrityl-tetraamine (3) was added to the composition. An overcoated film was prepared and processed according to Example III. The fresh strip had a Base plus FOG of 0.06 while another strip after aging three weeks at an ambient temperature of 70° F also had a Base plus Fog of 0.06.

EXAMPLE V

A photosensitive composition was prepared according to Example I by dissolving 100 mg of 2,7-bis(dimethylamino)-10-p-dimethylaminophenyl-9,10-dihydro-9,9-dimethylanthracene, 40 mg of 4-(p-dimethylaminostyryl)-quinoline, 38 mg of 3-methyl-4-ethylpyridene-N-oxide and 1.4 gm of carbon tetrabromide in 4.5 ml of a 15% by weight solution of a polymethacrylate ester dissolved in benzene. A film was prepared with the composition and was then overcoated with Gelvitol 20–60 (7% by weight aqueous solution) polyvinyl alcohol.

Other films were prepared by adding to this control formulation the imino compounds listed in Table 1.

All films were given identical 33,000 MCS exposures and processed as in Example I. The effect of the added compounds on retarding dark fog can be seen from Table 3.

Table 3

| Additive (Table 1) | Amount (mg) | Base Plus Fog After Storage for Various Times | | | |
|---|---|---|---|---|---|
| | | 0 Hrs. | 3 Hrs. | 24 Hrs. | 68 Hrs. |
| Control | None | .05 | .10 | .45 | 2.42 |
| 1 | 200 | .07 | — | .06 | .07 |
| 2 | 25 | .06 | — | .06 | .07 |
| 3 | 50 | .06 | — | .07 | .06 |
| 4 | 30 | .05 | — | .06 | .06 |
| 5 | 30 | .06 | — | .06 | .07 |
| 6 | 25 | .06 | — | .06 | .06 |
| 7 | 200 | .06 | — | .05 | .06 |
| 8 | 20 | .07 | — | .07 | .09 |
| 9 | 30 | .07 | — | .08 | .12 |

EXAMPLE VI

Photosensitive compositions and films were prepared as in Examples III and IV. A freshly prepared strip was given a white light exposure of 15 MCS with the overcoat in place. The overcoat was then removed and the film developed by blanket exposure at a distance of four inches from a red light produced by filtering a Marc 300 tungsten iodide lamp fitted with a parabolic reflector and a Wratten 89B gelatin filter placed over a Corning 2055 glass filter.

The control formulation of Example III, without additive was developed for three (3) minutes to produce five (5) steps with a Dmax of 0.60 and a Base plus Fog of 0.30. After twenty-four hours another strip had dark fogged to 2.42 and could not be developed. The film of Example IV was developed for 3.5 minutes to produce another eight-step blue image with a Dmax of 2.61 and a Base plus Fog of 0.28. Another strip of the film of Example IV after aging 24 hours at 70° F, after 3.5 minutes development exposure yielded a Dmax of 2.56 and a Base plus Fog of 0.34.

EXAMPLE VII

Photosensitive compositions and overcoated films were prepared according to Example V and were exposed, developed and processed according to Example VI. The results are seen in Table 4.

Table 4

| Additive (Table 1) | Am't (mg) | Age (Hrs) | Density of 1st Step | Base Plus Fog | Dev. Time (min) | No. of Steps | ASA |
|---|---|---|---|---|---|---|---|
| Control | None | 0 | 1.23 | 0.35 | 3.5 | 5 | .05 |
| | | 24 | 2.67 | 2.58 | 0 | 0 | — |
| 1 | 200 | 0 | 1.88 | 0.30 | 3.0 | 8 | .8 |
| | | 24 | 1.54 | 0.31 | 2.5 | 7 | .3 |
| 3 | 100 | 0 | 2.10 | 0.24 | 8.5 | 7 | 0.4 |
| | | 24 | 2.16 | 0.30 | 6.5 | 7 | 0.4 |
| 6 | 25 | 0 | 1.82 | .46 | 10.5 | 7 | 0.3 |
| | | 24 | 1.58 | .40 | 12.5 | 7 | 0.3 |
| 4 | 40 | 0 | 1.68 | .28 | 8.0 | 8 | 0.8 |
| | | 24 | 1.53 | .37 | 7.5 | 7 | 0.3 |
| 2 | 50 | 0 | 1.74 | .10 | 4.5 | 8 | 0.5 |
| | | 24 | 1.71 | .15 | 4.0 | 8 | 0.5 |

We claim:

1. In a photosensitive composition consisting essentially of:

a. at least one leuco diaryl- or triaryl-methane dye forming compound;

b. at least one dye base selected from the group consisting of styryl dye bases, cyanine dye bases and merocyanine dye bases;

c. at least one organic halogen compound which produces free radicals when exposed to a suitable dose of electromagnetic radiation; and d. a film forming polymer in which constituents (a), (b) and (c) are supported;

the improvement which comprises including in said composition an organic imino compound containing at least one hydroxyl group and selected from the group consisting of compounds represented by the following formulae:

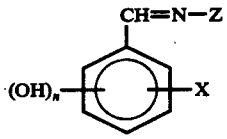

in which $n$ is an integer up to 3 and the OH groups occupy at least one ortho-site; X is an alkyl, aryl or halogen group and Z is selected from the group consisting of OH and alkyl with up to 4 carbon atoms;

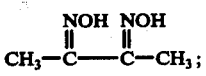

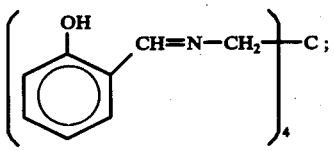

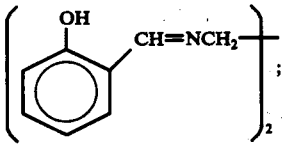

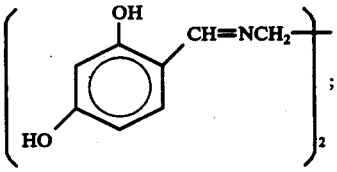

-continued

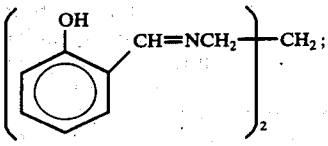

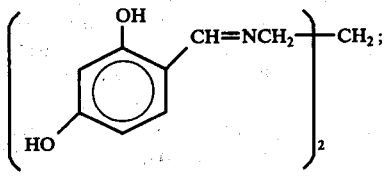

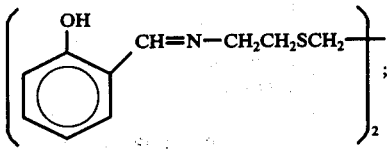

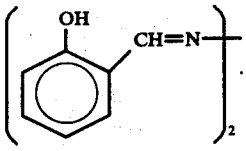

2. The composition of claim 1 wherein the amount of imino compound is between 1/100th and five times the combined weight of leuco dye and dye base in said composition.

3. The composition of claim 2 wherein the amount of imino compound is between 1/20th and 3/2 the combined weight of leuco dye and dye base.

4. The composition of claim 1 wherein the imino compound is N,N',N'',N'''-tetrasalicylidene pentaerythrityl tetraamine.

5. The composition of claim 1 wherein the imino compound is N,N'-disalicylidene-1,3-propane diamine.

6. The composition of claim 1 wherein the leuco compound is leuco crystal violet.

7. The composition of claim 1 wherein the leuco dye is 2,7-bis(dimethylamino)-10-p-dimethyalminiophenyl-9,10-dihydro-9,9-dimethylanthracene.

8. The composition of claim 1 wherein the leuco dye is 2,7-bis-(dimethylamino)-9,10-dihydro-9,9-dimethylanthracene.

9. The composition of claim 1 wherein the proportions are:

| Constituent | Broad Range | Preferred |
|---|---|---|
| Organic Halogen Compound | .10 - 10 | 1 - 4 |
| Leuco Dye | .01 - 0.1 | .4 - .1 |
| Dye Base | .5 - .01 | .05 - 0.2 |
| Imine Compound | .01 - 5* | .05 - 1.5* |
| Binder | 1 | 1 |

*times the combined weight of leuco compound and dye base.

10. A film comprising a photosensitive composition of claim 1 in layer form and wherein said photosensitive composition is overcoated uniformly with a layer of polyvinylalcohol or polyvinylpyrolidone.

11. A method of producing a visible image which comprises: preparing a member including a thin dried layer of photosensitive composition in accordance with claim 1; exposing said layer to a pattern of visible light;

thereby producing a visible image on the areas exposed to visible light; and thereafter fixing the image.

12. A method of producing a visible image which comprises: preparing a member including a thin dried layer of photosensitive composition in accordance with claim 1; laying on top of said layer of photosensitive composition a solution containing polyvinyl alcohol; drying said overcoat; exposing said dried layers to a pattern of visible light; thereby producing a visible image on the areas exposed to visible light; mechanically removing the polyvinyl alcohol containing overcoat; and thereafter fixing the image.

13. A method of producing a visible image which comprises: preparing a member including a thin dried layer of photosensitive composition in accordance with claim 1; laying on top of said layer of photosensitive composition a solution containing polyvinyl alcohol; drying said overcoat; exposing said dried layers to a pattern of visible light thereby producing a latent image on the areas exposed to said pattern of visible light; mechanically removing the polyvinyl alcohol containing overcoat; and after mechanical removal of the dried overcoat containing polyvinyl alcohol, the imagewise exposed photosensitive layer is then given a blanket exposure to red light having a wavelength longer than 600 nanometers; thereby producing a visible image in the areas first exposed to the pattern of visible light; and thereafter fixing the image.

* * * * *